US010738262B2

(12) United States Patent
Pelligra et al.

(10) Patent No.: US 10,738,262 B2
(45) Date of Patent: Aug. 11, 2020

(54) LUBRICATING OIL COMPOSITIONS WITH ENGINE WEAR PROTECTION

(71) Applicant: ExxonMobil Research and Engineering Company, Annandale, NJ (US)

(72) Inventors: Candice I. Pelligra, Rutlegde, PA (US); Smruti A. Dance, Robbinsville, NJ (US); Douglas E. Deckman, Easton, PA (US); Steven Kennedy, West Chester, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 16/151,481

(22) Filed: Oct. 4, 2018

(65) Prior Publication Data

US 2019/0127654 A1 May 2, 2019

Related U.S. Application Data

(60) Provisional application No. 62/578,696, filed on Oct. 30, 2017, provisional application No. 62/578,723,
(Continued)

(51) Int. Cl.
*C10M 105/32* (2006.01)
*C10M 105/06* (2006.01)
(Continued)

(52) U.S. Cl.
CPC ..... *C10M 169/04* (2013.01); *C10M 101/02* (2013.01); *C10M 105/06* (2013.01);
(Continued)

(58) Field of Classification Search
CPC combination set(s) only.
See application file for complete search history.

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A 1/1981
EP 464546 A1 1/1992
(Continued)

OTHER PUBLICATIONS

International Search Report and Written Opinion of PCT/US2018/054287 dated Jan. 21, 2019.
(Continued)

*Primary Examiner* — Ellen M Mcavoy
*Assistant Examiner* — Chantel L Graham
(74) *Attorney, Agent, or Firm* — Anthony G. Boone

(57) ABSTRACT

A method for improving wear control of a steel surface lubricated with a lubricating oil through the generation of thick tribofilms. The method includes: (i) using as the lubricating oil a formulated oil, the formulated oil having a composition comprising at least one lubricating oil base stock as a major component; and at least one lubricating oil additive, as a minor component; and (ii) forming a tribofilm on the steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11. In the method of this disclosure, elongation of timing chain due to wear of chain link pins is less than about 0.07%, as determined by Ford Chain Wear (FCW) test conducted in accor-
(Continued)

dance with ILSAC GF-6 specification. The lubricating oils are useful in internal combustion engines.

32 Claims, 11 Drawing Sheets

Related U.S. Application Data filed on Oct. 30, 2017, provisional application No. 62/578,711, filed on Oct. 30, 2017.

(51) Int. Cl.

| | |
|---|---|
| ***C10M 101/02*** | (2006.01) |
| ***C10M 107/02*** | (2006.01) |
| ***C10M 129/68*** | (2006.01) |
| ***C10M 129/54*** | (2006.01) |
| ***C10M 129/34*** | (2006.01) |
| ***C10M 133/10*** | (2006.01) |
| ***C10M 135/10*** | (2006.01) |
| ***C10M 155/04*** | (2006.01) |
| ***C10M 169/04*** | (2006.01) |
| ***C10M 141/08*** | (2006.01) |
| ***C10M 159/20*** | (2006.01) |
| ***C10M 159/24*** | (2006.01) |
| ***C10M 133/56*** | (2006.01) |
| ***C10M 133/16*** | (2006.01) |
| *C10N 10/02* | (2006.01) |
| *C10N 10/04* | (2006.01) |
| *C10N 20/02* | (2006.01) |
| *C10N 20/04* | (2006.01) |
| *C10N 30/04* | (2006.01) |
| *C10N 30/06* | (2006.01) |
| *C10N 30/10* | (2006.01) |
| *C10N 30/00* | (2006.01) |
| *C10N 40/25* | (2006.01) |
| *C10N 50/00* | (2006.01) |
| *C10N 60/14* | (2006.01) |

(52) U.S. Cl.

CPC ..... *C10M 105/32* (2013.01); *C10M 107/02* (2013.01); *C10M 129/34* (2013.01); *C10M 129/54* (2013.01); *C10M 129/68* (2013.01); *C10M 133/16* (2013.01); *C10M 133/56* (2013.01); *C10M 135/10* (2013.01); *C10M 141/08* (2013.01); *C10M 155/04* (2013.01); *C10M 159/20* (2013.01); *C10M 159/24* (2013.01); *C10M 2203/065* (2013.01); *C10M 2203/1006* (2013.01); *C10M 2203/1025* (2013.01); *C10M 2203/1065* (2013.01); *C10M 2207/142* (2013.01); *C10M 2207/144* (2013.01); *C10M 2207/262* (2013.01); *C10M 2207/2805* (2013.01); *C10M 2215/28* (2013.01); *C10M 2219/044* (2013.01); *C10M 2219/046* (2013.01); *C10N 2010/02* (2013.01); *C10N 2010/04* (2013.01); *C10N 2020/02* (2013.01); *C10N 2020/04* (2013.01); *C10N 2030/04* (2013.01); *C10N 2030/06* (2013.01); *C10N 2030/10* (2013.01); *C10N 2030/44* (2020.05); *C10N 2030/45* (2020.05); *C10N 2030/52* (2020.05); *C10N 2030/54* (2020.05); *C10N 2040/25* (2013.01); *C10N 2040/255* (2020.05); *C10N 2050/025* (2020.05); *C10N 2060/14* (2013.01)

(56) References Cited

U.S. PATENT DOCUMENTS

| | | | |
|---|---|---|---|
| 2,100,993 | A | 11/1937 | Bruson |
| 2,191,498 | A | 2/1940 | Reiff |
| 2,387,501 | A | 4/1944 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Jacob et al. |
| 3,036,003 | A | 5/1962 | Verdol |
| 3,087,936 | A | 4/1963 | Le Suer |
| 3,172,892 | A | 3/1965 | Le Suer et al. |
| 3,200,107 | A | 8/1965 | Le Suer |
| 3,219,666 | A | 11/1965 | Norman et al. |
| 3,222,670 | A | 12/1965 | Abraham |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | Van Der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,454,059 | A | 6/1984 | Pindar |
| 4,594,172 | A | 6/1986 | Sie |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best |
| 4,910,355 | A | 3/1990 | Shubkin et al. |
| 4,921,594 | A | 5/1990 | Miller |
| 4,943,672 | A | 7/1990 | Hamner et al. |
| 4,952,739 | A | 8/1990 | Chen |
| 4,956,122 | A | 9/1990 | Watts et al. |

(56) References Cited

U.S. PATENT DOCUMENTS

| | | | |
|---|---|---|---|
| 4,975,177 | A | 12/1990 | Garwood et al. |
| 5,068,487 | A | 11/1991 | Theriot |
| 5,075,269 | A | 12/1991 | Degnan et al. |
| 5,084,197 | A | 1/1992 | Gag |
| 5,366,648 | A | 11/1994 | Salomon et al. |
| 5,430,105 | A | 7/1995 | Redpath et al. |
| 5,705,458 | A | 1/1998 | Roby et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,323,164 | B1 | 11/2001 | Liesen et al. |
| 8,048,833 | B2 | 11/2011 | Habeeb et al. |
| 9,506,008 | B2 | 11/2016 | Gaal et al. |
| 2003/0171228 | A1 | 9/2003 | Deckman et al. |
| 2004/0087451 | A1 | 5/2004 | Mayer et al. |
| 2004/0242433 | A1 | 12/2004 | Mayer et al. |
| 2006/0052254 | A1 | 3/2006 | Shaw |
| 2006/0258550 | A1 | 11/2006 | Chambard et al. |
| 2007/0203030 | A1 | 8/2007 | Buck et al. |
| 2008/0020950 | A1 | 1/2008 | Gray et al. |
| 2008/0171677 | A1 | 7/2008 | Buck et al. |
| 2011/0245120 | A1 | 10/2011 | Bertram |
| 2012/0012076 | A1 | 1/2012 | Atkinson et al. |
| 2013/0267449 | A1 | 10/2013 | Hanyuda et al. |
| 2015/0045271 | A1 | 2/2015 | Yoshida |
| 2015/0322367 | A1 | 11/2015 | Burns et al. |
| 2015/0322368 | A1 | 11/2015 | Burns et al. |
| 2015/0322369 | A1 | 11/2015 | Burns et al. |
| 2015/0344807 | A1 | 12/2015 | Takeshima |
| 2016/0264906 | A1 | 9/2016 | Tang |
| 2016/0326452 | A1 | 11/2016 | Raguz et al. |
| 2016/0326453 | A1 | 11/2016 | Raguz et al. |
| 2017/0283733 | A1 * | 10/2017 | Preston ..... C10M 151/02 |

FOREIGN PATENT DOCUMENTS

| | | | | |
|---|---|---|---|---|
| EP | 464547 | A1 | 1/1992 | |
| EP | 1632552 | A1 | 3/2006 | |
| EP | 2194114 | A3 | 10/2010 | |
| EP | 2990469 | A1 | 3/2016 | |
| GB | 1350257 | A | 4/1974 | |
| GB | 1390359 | A | 4/1975 | |
| GB | 1440230 | A | 6/1976 | |
| JP | 2005220197 | A | 8/2005 | |
| JP | 5642949 | B2 | 2/2011 | |
| WO | 2012087775 | A1 | 6/2012 | |
| WO | 2015106090 | A1 | 7/2015 | |
| WO | WO-2015106090 | A1 * | 7/2015 | ..... C10M 167/00 |
| WO | 2016144880 | A1 | 9/2016 | |
| WO | 2016179168 | A1 | 11/2016 | |
| WO | 2017192202 | A1 | 11/2017 | |
| WO | WO-2017192202 | A1 * | 11/2017 | ..... C10M 135/10 |
| WO | 2018156304 | A1 | 8/2018 | |
| WO | 2018226277 | A1 | 12/2018 | |

OTHER PUBLICATIONS

International Search Report and Written Opinion of PCT/US2018/054291 dated Feb. 15, 2019.

International Search Report and Written Opinion of PCT/US2018/054294 dated Jan. 21, 2019.

Polat, et al, "Timing Chain Wear Assessment with Different Types of Oils," SAE Technical Paper Series, Apr. 20, 2009, Society of Automotive Engineers, Warrendale, Pennsylvania, US.

* cited by examiner

Fig. 2

| Grp V Base Stock (Abbreviation) | D445 Kinematic Viscosity, 100°C (cSt) | D445 Kinematic Viscosity, 40°C (cSt) | D5950 or D97 Pour Point (°C) | Viscosity Index | Temp for 50% Volatilized acc. M1567/ASV (°F) | D611 Aniline Point (°C) | D611 Mixed Aniline Point (°C) | Saturation traction 100°C, 1GPa, 50 mm/s |
|---|---|---|---|---|---|---|---|---|
| Low polarity monoester | 5.5 | 25.5 | -39 | 161 | 947 | 66 | 63 | 0.0788 |
| Alkylated naphthalene (5.4 cSt AN) | 5.4 | 35.8 | -42 | 77 | 791 | 38 | 44 | 0.0806 |
| Alkylated naphthalene (4.8 cSt AN) | 4.8 | 28.4 | -39 | 82 | 791 | 33 | 43 | 0.0957 |
| Alkylated diphenyl oxide (ADPO) | 4.3 | 22.8 | -51 | 89 | 821 | 5 | 33 | 0.0757 |
| Tertiary alkyl liquid amide | 4.5 | 25.7 | < -60 | 77 | 813 | 0 | 25 | 0.0687 |
| iso-C9 Trimethylol propane ester (iC9 TMP) | 7.2 | 51.5 | -50 | 97 | 849 | < 0 | 15 | 0.093 |
| C9 Trimethylol propane ester (C9 TMP) | 3.4 | 13.9 | -56 | 120 | 917 | < 0 | 7 | 0.0751 |
| C8/C10 Trimethylol propane ester (C8/C10 TMP) | 4.3 | 19.1 | -54 | 136 | 899 | < 0 | 5 | 0.0876 |
| C7 Trimethylol propane ester ( C7 TMP) | 4.6 | 20.5 | < -60 | 146 | 833 | < 0 | 1 | 0.0831 |

Fig. 3

| | Inventive Example 1 | Inventive Example 2 | Inventive Example 3 | Comparative Example A | Comparative Example B | Comparative Example C | Comparative Example D |
|---|---|---|---|---|---|---|---|
| Grp III-IV Base Oil | 73.94 | 73.94 | 73.94 | 73.94 | 73.94 | 73.94 | 68.94 |
| Grp V Base Oil | | | | | | | |
| *C8/C10 TMP* | *0* | *0* | *0* | *5* | *0* | *0* | *5* |
| *4.8 cSt AN* | *5* | *0* | *0* | *0* | *0* | *0* | *5* |
| *5.4 cSt AN* | *0* | *5* | *0* | *0* | *0* | *0* | *0* |
| *5.5 cSt nonpolar monoester* | *0* | *0* | *5* | *0* | *0* | *0* | *0* |
| *4.5 cSt Liquid amide* | *0* | *0* | *0* | *0* | *5* | *0* | *0* |
| *4.3 cSt ADPO* | *0* | *0* | *0* | *0* | *0* | *5* | *0* |
| Rest of Formulation | 21.06 | 21.06 | 21.06 | 21.06 | 21.06 | 21.06 | 16.06 |
| | | | | | | | |
| Saturation Traction Coeff., $f_s$ | 0.128 | 0.113 | 0.129 | 0.100 | 0.103 | 0.0984 | 0.097 |

Fig. 4

| Description | Inventive Example 3 0% AN | Inventive Example 1 5% AN | Inventive Example 4 10% AN | Inventive Example 5 20% AN | Comparative Example E 30% AN |
|---|---|---|---|---|---|
| Grp III-IV Base Oil | 78.94 | 73.94 | 68.94 | 58.94 | 48.94 |
| Grp V Base Oil | | | | | |
| 4.8 cSt AN | 0 | 5 | 10 | 20 | 30 |
| Borated succinimide dispersant | 1.3 | 1.3 | 1.3 | 1.3 | 1.3 |
| ppm B | 100 | 100 | 100 | 100 | 100 |
| Rest of Formulation | 19.76 | 19.76 | 19.76 | 19.76 | 19.76 |
| | | | | | |
| Saturation Traction Coeff., $f_s$ | 0.129 | 0.128 | 0.13 | 0.131 | 0.097 |

Fig. 5

| Description | Comparative Example F<br>0% TMP Ester | Comparative Example A<br>5% TMP Ester | Comparative Example G<br>15% TMP Ester | Comparative Example H<br>50% TMP Ester |
|---|---|---|---|---|
| Grp III-IV Base Oil | 78.94 | 73.94 | 63.94 | 28.94 |
| Grp V Base Oil | | | | |
| C8/C10 TMP Ester | 0 | 5 | 15 | 50 |
| Borated succinimide dispersant | 1.3 | 1.3 | 1.3 | 1.3 |
| ppm B | 100 | 100 | 100 | 100 |
| Rest of Formulation | 19.76 | 19.76 | 19.76 | 19.76 |
| | | | | |
| Saturation Traction Coeff. | 0.129 | 0.092 | 0.098 | 0.098 |

Fig. 6

| | Comparative Example I | Comparative Example J | Comparative Example K | Comparative Example L |
|---|---|---|---|---|
| Description | C8/C10 TMP Ester | C7 TMP Ester | C9 TMP Ester | iC9 TMP Ester |
| Grp III-IV Base Oil | 29.44 | 28.94 | 28.94 | 28.94 |
| TMP Ester Grp V Base Oil | | | | |
| *C8/C10 TMP* | *50* | *0* | *0* | *0* |
| *C7 TMP* | *0* | *50* | *0* | *0* |
| *C9 TMP* | *0* | *0* | *50* | *0* |
| *iC9 TMP* | *0* | *0* | *0* | *50* |
| Rest of Formulation | 20.56 | 21.06 | 21.06 | 21.06 |
| | | | | |
| Saturation Traction Coeff., $f_s$ | 0.098 | 0.100 | 0.085 | 0.095 |

Fig. 7

| Description | Inventive Example 1 | Inventive Example 5 | Inventive Example 6 | Inventive Example 7 | Inventive Example 8 |
|---|---|---|---|---|---|
| | | All Grp II | All Grp III- GTL | All Grp III- Yubase | All Grp IV |
| Grp II-IV Base Oil | 73.94 | 73.94 | 73.94 | 73.94 | 73.94 |
| Grp III Base Oil | 0 | 0 | 73.94 | 0 | 0 |
| Grp IV Base Oil | 0 | 0 | 0 | 73.94 | 73.94 |
| Grp V Base Oil | | | | | |
| *4.8 cSt AN* | *5* | *5* | *5* | *5* | *5* |
| Rest of Formulation | 21.06 | 21.06 | 21.06 | 21.06 | 21.06 |
| | | | | | |
| Saturation Traction Coeff., $f_s$ | 0.128 | 0.124 | 0.128 | 0.128 | 0.125 |

Fig. 8

| | Inventive Example 9 | Inventive Example 10 | Inventive Example 11 | Inventive Example 12 | Comparative Example M | Comparative Example N | Comparative Example O | Comparative Example P |
|---|---|---|---|---|---|---|---|---|
| Grp III-IV Base Oil | 74.39 | 73.74 | 73.24 | 71.99 | 74.82 | 74.84 | 73.24 | 72.49 |
| C8/C10 TMP | 5 | 5 | 5 | 5 | 5 | 5 | 5 | 5 |
| Borated succinimide dispersant | 0.85 | 1.5 | 2 | 3.25 | 0.42 | 0 | 0 | 0 |
| Non-borated succinimide dispersant | 0 | 0 | 0 | 0 | 0 | 0.4 | 2 | 3.25 |
| *B (ppm)* | *200* | *350* | *500* | *800* | *100* | *0* | *0* | *0* |
| *Dispersant Nitrogen content (ppm)* | *1050* | *1125* | *1139* | *1288* | *1000* | *1000* | *1139* | *1288* |
| Rest of Formulation | 19.76 | 19.76 | 19.76 | 19.76 | 19.76 | 19.76 | 19.76 | 19.26 |
| | | | | | | | | |
| Saturation Traction Coeff., $f_s$ | 0.127 | 0.127 | 0.125 | 0.128 | 0.090 | 0.097 | 0.090 | 0.084 |

Fig. 9

| | Comparative Example M | Comparative Example Q |
|---|---|---|
| Grp III-IV Base Oil | 74.82 | 73.94 |
| C8/C10 TMP | 5 | 5 |
| Borated succinimide dispersant | 0.42 | 1.3 |
| *B (ppm)* | *100* | *100* |
| *Dispersant Nitrogen content (ppm)* | *1000* | *1105* |
| Rest of Formulation | 19.76 | 19.76 |
| | | |
| Saturation Traction Coeff., $f_s$ | 0.090 | 0.093 |

Fig. 10

| | Inventive Example 13 | Inventive Example 14 | Inventive Example 15 | Inventive Example 16 | Inventive Example 17 | Inventive Example 18 | Comparative Example R |
|---|---|---|---|---|---|---|---|
| Grp III-IV Base Oil | 74.39 | 73.74 | 74.39 | 73.74 | 73.04 | 71.74 | 74.82 |
| 4.3 cSt AN | 5 | 5 | 0 | 0 | 0 | 0 | 0 |
| 5.5 cSt nonpolar monoester | 0 | 0 | 5 | 5 | 5 | 5 | 5 |
| Borated succinimide dispersant | 0.85 | 1.5 | 0.85 | 1.5 | 2.2 | 3.5 | 0.425 |
| *B (ppm)* | *200* | *350* | *200* | *350* | *500* | *800* | *100* |
| *Dispersant Nitrogen content (ppm)* | *1050* | *1125* | *1050* | *1125* | *1210* | *1360* | *1000* |
| Rest of Formulation | 19.76 | 19.76 | 19.76 | 19.76 | 19.76 | 19.76 | 19.76 |
| [redacted] | | | | | | | |
| Saturation Traction Coeff., $f_s$ | 0.127 | 0.127 | 0.127 | 0.130 | 0.135 | 0.135 | 0.092 |

Fig. 11

| | Inventive Example 19 | Inventive Example 20 | Comparative Example N | Comparative Example S |
|---|---|---|---|---|
| Grp III-IV Base Oil | 74.94 | 75.38 | 73.94 | 73.34 |
| C8/C10 TMP | 5 | 5 | 5 | 5 |
| Detergent | | | | |
| *Mixed Ca Salicylates* | 0 | 0 | 1 | 0 |
| *High TBN Mg Sulfonate* | 0.83 | 0.83 | 0.83 | 0.83 |
| *Low TBN Ca Salicylate* | 1 | 0 | 2 | 3 |
| *High TBN Ca Salicylate* | 1 | 0.96 | 0 | 0.6 |
| Rest of Formulation | 17.23 | 17.83 | 17.23 | 17.23 |
| | | | | |
| Detergent Soap Content | 0.8 | 0.5 | 1.1 | 1.3 |
| | | | | |
| B (ppm) | 100 | 100 | 100 | 100 |
| | | | | |
| Saturation Traction Coeff., $f_s$ | 0.114 | 0.133 | 0.093 | 0.095 |

LUBRICATING OIL COMPOSITIONS WITH ENGINE WEAR PROTECTION

CROSS-REFERENCE TO RELATED APPLICATIONS

This application claims the benefit of U.S. Provisional Application No. 62/578,723, and U.S. Provisional Application Nos. 62/578,696 and 62/578,711, all filed on Oct. 30, 2017, the entire contents of which are incorporated herein by reference.

FIELD

This disclosure relates to methods for improving wear control of a steel surface lubricated with a lubricating oil, through the generation of thick tribofilms. The lubricating oils are useful in internal combustion engines.

BACKGROUND

During low-speed operation of light-duty passenger vehicle engines, moving metal surfaces in the engine and valvetrain assemblies are typically exposed to boundary- and mixed-layer lubrication contacts. In these lubrication regimes, the lubricant film thickness is insufficient to adequately separate metal surfaces, and microscale asperities come into contact which causes plastic deformation (wear) to occur. Thus, to protect against wear under low-speed conditions, lubricants are formulated to contain thermomechanically-activated species which deposit on or react with steel surfaces. The formed layer, or tribofilm, acts as a barrier to prevent metal-metal contact and potential wear. Thick tribofilms prevent contact between even the highest asperities in rough regions.

In general, tribofilms are sacrificial layers, with material being removed as surfaces come into contact and then rebuilt as re-lubrication of the contact delivers more of the film-forming components to the interface. Successful wear protection is thus enabled by rates of film generation that are on par with the rate of film removal. A significant challenge relates to the ability of a tribofilm to remain adequately thick under severe contact conditions where interface re-lubrication may not be guaranteed.

This issue is particularly relevant with the development of the Ford chain wear (FCW) engine test in the new ILSAC GF-6 category. In this test, the rated parameter is wear on the timing chain. The metal-metal contact between the link pin and link plate is a small-displacement reciprocating motion, causing oil to be squeezed out of the contact with challenged replenishment. Furthermore, the FCW test is run in a gasoline direct-injection (GDI) engine. This fuel delivery configuration produces some amount of soot content that may compete with oil additives for the surface and/or increase local oil viscosity in narrow contact regions through chemical or physical means. Identifying formulation strategies which provide thick-forming films that provide adequate separation of surfaces even in challenged lubrication conditions is thus of great importance for reducing wear.

Zinc dialkyldithiophosphates (ZDDPs) are considered to be the main contributor to tribofilm formation. Unfortunately, ZDDPs release volatile phosphorus as a decomposition product which can poison catalytic converters, and thus strict limits on phosphorus and phosphorus volatility have been established for modern engine oil specifications. Limiting the amount of ZDDP in a formulation removes a main lever for increasing tribofilm thickness.

A major challenge in engine oil formulation is achieving wear protection in the FCW test, in particular, developing lubricating oil formulations which provide thick-forming tribofilms that provide adequate separation of surfaces even in challenged lubrication conditions.

SUMMARY

This disclosure relates to methods for improving wear control of a steel surface lubricated with a lubricating oil, through the generation of thick tribofilms. The lubricating oil formulation features of this disclosure permit the formation of thick tribofilms on steel surfaces under loading/temperature conditions relevant to light-duty passenger vehicle operation. These thick tribofilms provide superior wear protection in FCW testing. The lubricating oils are useful in internal combustion engines.

This disclosure relates in part to methods for reducing chain wear by formulating engine lubricants which exhibit thick tribofilms. The lubricant formulation strategies of this disclosure enable the formation of thick tribofilms on steel surfaces in boundary/mixed layer lubrication contacts in order to reduce wear. The methods of this disclosure are surprising, as the formulation features corresponding to thick tribofilm generation and consequent low wear in the FCW test do not adhere to expected strategies for reducing soot-induced wear, which is a key feature of the FCW test.

In accordance with this disclosure, lubricant formulations are provided for the formation of thick tribofilms on steel surfaces in boundary/mixed layer lubrication contacts in order to reduce wear. In an embodiment, the thickness of tribofilms is increased by the use of high levels of borated succinimide dispersants and/or formulating in low-soap detergent systems. The formulation features described herein permit the formation of thick tribofilms on steel surfaces under loading/temperature conditions relevant to light-duty passenger vehicle operation. The thick tribofilms of this disclosure provide superior wear protection compared to thinner tribofilms.

This disclosure relates in part to a method for improving wear control of a steel surface lubricated with a lubricating oil. The method comprises: (i) using as the lubricating oil a formulated oil, the formulated oil having a composition comprising at least one lubricating oil base stock as a major component; and at least one lubricating oil additive, as a minor component; and (ii) forming a tribofilm on the steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure also relates in part to a lubricating oil composition comprising at least one lubricating oil base stock as a major component, and at least one lubricating oil additive, as a minor component. The at least one lubricating oil base stock and the at least one lubricating oil additive are present in an amount to form a tribofilm on a steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure further relates in part to a method for improving wear control of a steel surface lubricated with a lubricating oil. The method comprises: (i) using as the lubricating oil a formulated oil, the formulated oil having a composition comprising at least one lubricating oil base stock as a major component; and at least one lubricating oil additive, as a minor component; and (ii) forming a tribofilm on the steel surface. The at least one lubricating oil base stock comprises a Group V base stock having an aniline point greater than about 10° C., or a mixed aniline point greater than about 35° C., as determined by ASTM D611. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure yet further relates in part to a lubricating oil composition comprising at least one lubricating oil base stock as a major component, and at least one lubricating oil additive, as a minor component. The at least one lubricating oil base stock comprises a Group V base stock having an aniline point greater than about 10° C., or a mixed aniline point greater than about 35° C., as determined by ASTM D611. The at least one lubricating oil base stock and the at least one lubricating oil additive are present in an amount to form a tribofilm on a steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure still further relates in part to a method for improving wear control of a steel surface lubricated with a lubricating oil. The method comprises: (i) using as the lubricating oil a formulated oil, the formulated oil having a composition comprising at least one lubricating oil base stock as a major component; and at least one dispersant, as a minor component; and (ii) forming a tribofilm on the steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure also relates in part to a lubricating oil composition comprising at least one lubricating oil base stock as a major component, and at least one dispersant, as a minor component. The at least one lubricating oil base stock and the at least one dispersant are present in an amount to form a tribofilm on a steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure further relates in part to a method for improving wear control of a steel surface lubricated with a lubricating oil. The method comprises: (i) using as the lubricating oil a formulated oil, the formulated oil having a composition comprising at least one lubricating oil base stock as a major component; and at least one dispersant, as a minor component; and (ii) forming a tribofilm on the steel surface. The at least one lubricating oil base stock comprises an ester base stock. The at least one dispersant comprises at least one borated dispersant. The at least one borated dispersant is present in an amount sufficient to provide a total boron concentration of about 200 to about 800 parts per million in the lubricating oil. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure yet further relates in part to a lubricating oil composition comprising at least one lubricating oil base stock as a major component, and at least one dispersant, as a minor component. The at least one lubricating oil base stock comprises an ester base stock. The at least one dispersant comprises at least one borated dispersant. The at least one borated dispersant is present in an amount sufficient to provide a total boron concentration of about 200 to about 800 parts per million in the lubricating oil. The at least one lubricating oil base stock and the at least one dispersant are present in an amount to form a tribofilm on a steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure still further relates in part to a method for improving wear control of a steel surface lubricated with a lubricating oil. The method comprises: (i) using as the lubricating oil a formulated oil, the formulated oil having a composition comprising at least one lubricating oil base stock as a major component; and at least one detergent, as a minor component; and (ii) forming a tribofilm on the steel surface. The total amount of soap delivered by the at least one detergent is about 0.5 weight percent to about 0.8 weight percent of the lubricating oil. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

This disclosure also relates in part to a lubricating oil composition comprising at least one lubricating oil base stock as a major component, and at least one detergent, as a minor component. The total amount of soap delivered by the at least one detergent is about 0.5 weight percent to about 0.8 weight percent of the lubricating oil. The at least one lubricating oil base stock and the at least one detergent are present in an amount to form a tribofilm on a steel surface. In time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

It has been surprisingly found that, in accordance with this disclosure, improvements in wear control of a steel surface lubricated with a lubricating oil are obtained, through the generation of thick tribofilms. The formulation features corresponding to thick tribofilm generation and consequent low wear in the FCW test do not adhere to expected strategies for reducing soot-induced wear, which is a key feature of the FCW test.

In particular, it has been surprisingly found that, in accordance with this disclosure, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11. Also, it has been surprisingly found that, in accordance with this disclosure, elongation of timing chain due to wear of chain link pins is less than about 0.07%, as determined by the FCW test conducted in accordance with ILSAC GF-6 specification.

Other objects and advantages of the present disclosure will become apparent from the detailed description that follows.

BRIEF DESCRIPTION OF THE DRAWINGS

FIG. 2 summarizes the Group V base stocks used in the Examples, including basic physical properties, aniline points (ASTM D611), temperature of 50% volatility (M1567), and saturation traction coefficient of the neat base stock.

FIG. 3 summarizes saturation traction coefficient $f_s$ for the series of oils in which Group V base stock type was modified in accordance with the Examples.

FIG. 4 summarizes the results of an investigation for preserving a formulation's thick-tribofilm forming ability in the presence of a Group V base stock by increasing the concentration of 4.8 cSt AN in a formulation in accordance with the Examples.

FIG. 5 summarizes the formulation and saturation traction coefficient $f_s$ of blends modifying C8/C10 TMP ester Group V base stock content in accordance with the Examples.

FIG. 6 summarizes formulation and saturation traction coefficient $f_s$ of blends modifying Group V TMP ester base stock type in accordance with the Examples.

FIG. 7 shows the saturation traction coefficient $f_s$ for blends based on the same performance chemistry and using the same Group V base stock (4.8 cSt AN) but different Group II-IV base stock compositions, in accordance with the Examples.

FIG. 8 summarizes formulation and saturation traction coefficient $f_s$ of blends modifying boron content with C8/C10 TMP Ester Group V, in accordance with the Examples.

FIG. 9 summarizes formulation and saturation traction coefficient $f_s$ of blends with 100 ppm B and different dispersant sources, in accordance with the Examples.

FIG. 10 summarizes formulation and saturation traction coefficient $f_s$ of blends modifying boron content with 4.3 cSt AN Group V and low polarity monoester formed by the reaction of a C19 acid with a C20 alcohol Group V, in accordance with the Examples.

FIG. 11 summarizes formulation and saturation traction coefficient $f_s$ of blends modifying detergent soap concentration, in accordance with the Examples.

DETAILED DESCRIPTION

Figure 1:
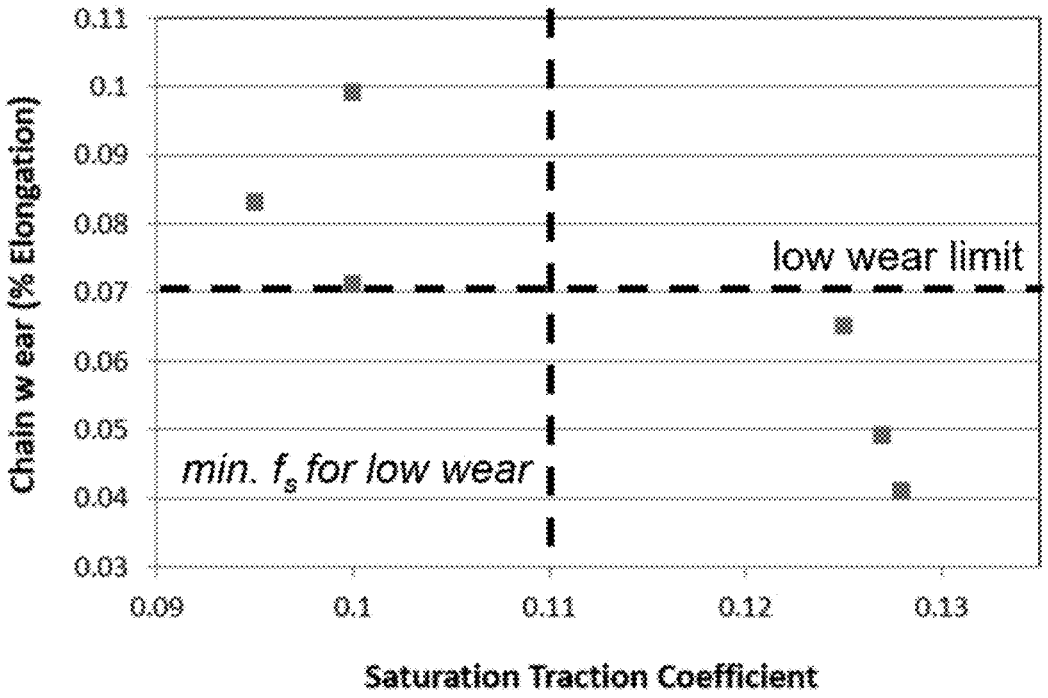
FIG. 1 is a plot of chain elongation in the FCW test as a function of traction coefficient measured in the tribological test described in Table 2 of the Examples.

All numerical values within the detailed description and the claims herein are modified by "about" or "approximately" the indicated value, and take into account experimental error and variations that would be expected by a person having ordinary skill in the art. The phrase "major amount" as it relates to components included within the lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil. The phrase "minor amount" as it relates to components included within the lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil. The phrase "essentially free" as it relates to components included within the lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm). The phrase "other lubricating oil additives" as used in the specification and the claims means other lubricating oil additives that are not specifically recited in the particular section of the specification or the claims. For example, other lubricating oil additives may include, but are not limited to, antioxidants, detergents, dispersants, antiwear additives, corrosion inhibitors, viscosity modifiers, metal passivators, pour point depressants, seal compatibility agents, antifoam agents, extreme pressure agents, friction modifiers and combinations thereof.

It has now been found that improved wear control can be attained of a steel surface through the generation of thick tribofilms. The lubricating oil formulation features of this disclosure permit the formation of thick tribofilms on steel surfaces under loading/temperature conditions relevant to light-duty passenger vehicle operation. These thick tribofilms provide superior wear protection in FCW testing. In particular, the lubricant formulation strategies of this disclosure enable the formation of thick tribofilms on steel surfaces in boundary/mixed layer lubrication contacts in order to reduce wear.

Also, for the lubricating oils of this disclosure, it has been found that, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than about 0.11.

Further, for the lubricating oils of this disclosure, it has been found that elongation of timing chain due to wear of chain link pins is less than about 0.07%, as determined by FCW test conducted in accordance with ILSAC GF-6 specification.

In an embodiment, the lubrication regime at the steel surface comprises boundary- and mixed-layer lubrication contacts and, in particular, the steel surface comprises the surface of a timing chain.

In an embodiment, the methods of this disclosure improve soot-induced wear control of a steel surface through the generation of thick tribofilms.

The present disclosure provides lubricant compositions with excellent antiwear properties attained through the generation of thick tribofilms. Antiwear additives are generally required for reducing wear in operating equipment where two solid surfaces engage in contact. In the absence of antiwear chemistry, the surfaces can rub together causing material loss on one or both surfaces which can eventually lead to equipment malfunction and failure. Antiwear additives can produce a protective surface layer which reduces wear and material loss. Most commonly the materials of interest are metals such as steel and other iron-containing alloys. However, other materials such as ceramics, polymer coatings, diamond-like carbon, corresponding composites, and the like can also be used to produce durable surfaces in modern equipment. The lubricant compositions of this disclosure can provide antiwear properties to such surfaces through the generation of thick tribofilms.

The lubricant compositions of this disclosure provide advantaged wear, including advantaged wear and friction, performance in the lubrication of internal combustion engines, power trains, drivelines, transmissions, gears, gear trains, valve trains, gear sets, and the like, through the generation of thick tribofilms. Preferably, the lubricating oil formulations of this disclosure permit the formation of thick tribofilms on steel surfaces under loading/temperature conditions relevant to light-duty passenger vehicle operation.

Also, the lubricant compositions of this disclosure provide advantaged wear, including advantaged wear and friction, performance in the lubrication of mechanical components, which can include, for example, pistons, piston rings, cylinder liners, cylinders, cams, tappets, lifters, bearings (journal, roller, tapered, needle, ball, and the like), gears, valves, and the like, through the generation of thick tribofilms under loading/temperature conditions relevant to light-duty passenger vehicle operation.

Further, the lubricant compositions of this disclosure provide advantaged wear, including advantaged wear and friction, performance as a component in lubricant compositions, which can include, for example, lubricating liquids, semi-solids, solids, greases, dispersions, suspensions, material concentrates, additive concentrates, and the like.

Also, the lubricant compositions of this disclosure provide advantaged wear, including advantaged wear and friction, performance in spark-ignition internal combustion engines, compression-ignition internal combustion engines, mixed-ignition (spark-assisted and compression) internal combustion engines, and the like, through the generation of thick tribofilms under loading/temperature conditions relevant to light-duty passenger vehicle operation.

Further, the lubricant compositions of this disclosure provide advantaged wear, including advantaged wear and friction, performance through the generation of thick tribofilms on lubricated surfaces that include, for example, the following: metals, metal alloys, non-metals, non-metal alloys, mixed carbon-metal composites and alloys, mixed carbon-nonmetal composites and alloys, ferrous metals, ferrous composites and alloys, non-ferrous metals, non-ferrous composites and alloys, titanium, titanium composites and alloys, aluminum, aluminum composites and alloys, magnesium, magnesium composites and alloys, ion-implanted metals and alloys, plasma modified surfaces; surface modified materials; coatings; mono-layer, multi-layer, and gradient layered coatings; honed surfaces; polished surfaces; etched surfaces; textured surfaces; micro and nano structures on textured surfaces; super-finished surfaces; diamond-like carbon (DLC), DLC with high-hydrogen content, DLC with moderate hydrogen content, DLC with low-hydrogen content, DLC with near-zero hydrogen content, DLC composites, DLC-metal compositions and composites, DLC-nonmetal compositions and composites; ceramics, ceramic oxides, ceramic nitrides, FeN, CrN, ceramic carbides, mixed ceramic compositions, and the like; polymers, thermoplastic polymers, engineered polymers, polymer blends, polymer alloys, polymer composites; materials compositions and composites containing dry lubricants, that include, for example, graphite, carbon, molybdenum, molybdenum disulfide, polytetrafluoroethylene, polyperfluoropropylene, polyperfluoroalkylethers, and the like.

Lubricating Oil Base Stocks and Co-Base Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{12}$ to $C_{18}$ may be used to provide low viscosity base stocks of acceptably low volatility. Depending on the viscosity grade and the starting oligomer, the PAOs may be predominantly dimers, trimers and tetramers of the starting olefins, with minor amounts of the lower and/or higher oligomers, having a viscosity range of 1.5 cSt to 12 cSt. PAO fluids of particular use may include 3 cSt, 3.4 cSt, and/or 3.6 cSt and combinations thereof. Mixtures of PAO fluids having a viscosity range of 1.5 cSt to approximately 150 cSt or more may be used if desired. Unless indicated otherwise, all viscosities cited herein are measured at 100° C.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or to ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 2 cSt to about 50 cSt, preferably about 2 cSt to about 30 cSt, more preferably about 3 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl biphenyls, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 2 cSt to about 50 cSt are preferred, with viscosities of approximately 3 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Alkylated naphthalene and analogues may also comprise compositions with isomeric distribution of alkylating groups on the alpha and beta carbon positions of the ring structure. Distribution of groups on the alpha and beta positions of a naphthalene ring may range from 100:1 to 1:100, more often 50:1 to 1:50 Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorus and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from about 6 to about 99 weight percent or from about 6 to about 95 weight percent, preferably from about 50 to about 99 weight percent or from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, to according to ASTM standards, of about 2.5 cSt to about 18 cSt (or $mm^2/s$) at 100° C. and preferably of about 2.5 cSt to about 12.5 cSt (or $mm^2/s$) at 100° C., often more preferably from about 2.5 cSt to about 10 cSt. Mixtures of synthetic and natural base oils may be used if desired. Bi-modal, tri-modal, and additional combinations of mixtures of Group I, II, III, IV, and/or V base stocks may be used if desired.

The co-base stock component is present in an amount sufficient for providing solubility, compatibility and dispersancy of polar additives in the lubricating oil. The co-base stock component is present in the lubricating oils of this disclosure in an amount from about 1 to about 99 weight percent, preferably from about 5 to about 95 weight percent, and more preferably from about 10 to about 90 weight percent.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Preferred dispersants useful in this disclosure include, for example, borated succinimides. The borated succinimides are preferably used in an amount sufficient to provide a total boron concentration of about 200 to about 800 parts per million in the lubricating oil. Boron content in the finished lubricating oil can vary from about 100 ppm by weight to about 1000 ppm by weight, preferably from about 150 ppm by weight to about 950 ppm by weight, and more preferably from about 200 ppm by weight to about 800 ppm by weight, or from about 250 ppm by weight to about 750 ppm by weight.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Illustrative dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically Mn, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by weight, and an isobutene content of 30 to 60% by weight. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.001 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 200 ppm by weight to about 2000 ppm by weight, preferably from about 200 ppm by weight to about 1200 ppm by weight. Basic nitrogen can vary from about 100 ppm by weight to about 1000 ppm by weight, preferably from about 100 ppm by weight to about 600 ppm by weight.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Detergents

Illustrative detergents useful in this disclosure include, for example, alkaline earth metal salicylates, alkaline earth metal sulfonates, and mixtures thereof.

In an embodiment, the present disclosure provides a detergent additive useful in lubricating oil compositions comprising a salicylate detergent, a sulfonate detergent, a mixture of salicylate detergents, a mixture of sulfonate detergents, or a mixture of salicylate and sulfonate detergents, all of varying total base number (TBN). In one preferred mode, mixtures of low, medium, and high TBN detergents are used.

Within the scope of the present disclosure, a low TBN detergent is defined as having a TBN of less than about 100. A medium TBN detergent is defined as having a TBN of between about 100 and 200. A high TBN detergent is defined as having a TBN of greater than about 200.

Low TBN refers to neutral to low-overbased detergents, medium TBN refers to medium overbased-detergents, and high TBN refers to high-overbased detergents. These terms are used descriptively to describe the general differences between the TBN of the detergents used and are meant to describe in general terms the differences between the contained calcium levels and the presence or absence and/or the degree of overbasing derived by the carbonation of the calcium salicylate in the presence of excess (over and beyond stoichiometric quantities) of calcium bases to form overbased calcium carbonate complexed calcium salicylate detergents.

In an embodiment, mixed TBN detergents of the present disclosure are incorporated into lubricating oil compositions. In one preferred mode, at least two of about 0.2% to about 4% of low TBN detergent, about 0.2% to about 4% of medium TBN detergent, and about 0.2% to about 4% of high TBN detergent (all percentages based on total weight of the lubricating oil composition and based on an active ingredient basis which excludes oil diluents and the like used in commercial products) are added to the lubricating oil composition. In one embodiment, all three detergents are added. Preferably the detergent is (i) a salicylate detergent, more preferably a calcium or magnesium salicylate detergent, (ii) a sulfonate detergent, more preferably a calcium or magnesium sulfonate detergent, (iii) a mixture of salicylate detergents, more preferably a mixture of calcium and/or magnesium salicylate detergents, (iv) a mixture of sulfonate detergents, more preferably a mixture of calcium and/or magnesium sulfonate detergents, or (v) a mixture of salicylate detergents and sulfonate detergents, more preferably a mixture of calcium and/or magnesium salicylate detergents and sulfonate detergents.

Salicylate detergents may be prepared by reacting a basic metal compound with at least one salicylic acid compound and removing free water from the reaction product. Useful salicylates include long chain alkyl salicylates. One useful family of compositions is of the formula

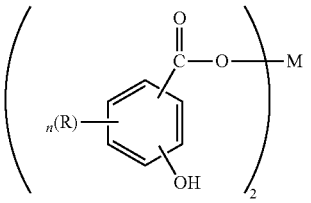

where R is a hydrogen atom or an alkyl group having 1 to about 30 carbon atoms, n is an integer from 1 to 4, and M is an alkaline earth metal. Preferred are alkyl chains of at least C11, preferably C13 or greater. R may be optionally substituted with substituents that do not interfere with the detergent's function. M is preferably, calcium, magnesium, or barium. More preferably, M is calcium or magnesium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Sulfonate detergents may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 or more carbon atoms, more typically from about 16 to 60 carbon atoms.

M. W. Ranney in "Lubricant Additives" published by Noyes Data Corporation of Parkridge, N.J. (1973) discloses a number of overbased metal salts of various sulfonic acids that are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates which are useful as detergents.

The detergents useful in this disclosure provide select levels of soap content to the lubricating oil compositions, which is discussed in more detail in the Examples herein. By one approach, the detergent provides a lower soap content, e.g., about 0.2 to about 0.9 percent soap content, or about 0.3 to about 0.8 percent soap content, or about 0.4 to about 0.7 percent soap content, to the final lubricating oil composition, for any ratio of alkaline earth metal salicylate soap to alkaline earth metal sulfonate soap.

In other approaches, the detergent provides a higher soap content, e.g., about 0.6 to about 1.5 percent soap, or about 0.7 to about 1.4 percent soap, or about 0.8 to about 1.3 percent soap, to the final lubricating oil composition, when alkaline earth metal sulfonate soap comprises from about 50 to about 100 percent of the total detergent soap.

In still other approaches, when the alkaline earth metal sulfonate soap comprises about 100 percent of the total detergent soap, the total amount of soap delivered is about 0.1 weight percent to about 1.0 weight percent, preferably about 0.4 weight percent to about 0.6 weight percent, more preferably 0.5 weight percent, of the lubricating oil.

Soap content generally refers to the amount of neutral organic acid salt and reflects a detergent's cleansing ability, or detergency, and dirt suspending ability. The soap content can be determined by the following formula, using an exemplary calcium sulfonate detergent represented by $(RSO_3)_vCa_w(CO_3)_x(OH)_y$ with v, w, x, and y denoting the number of sulfonate groups, the number of calcium atoms, the number of carbonate groups, and the number of hydroxyl groups respectively):

$$\text{soap content} = \frac{\text{formula weight of } [(RSO_3)_2Ca]}{\text{effective formula weight}} \times 100$$

Effective formula weight is the combined weight of all the atoms that make up the formula $(RSO_3)_vCa_w(CO_3)_x(OH)_y$ plus that of any other lubricant components. Further discussion on determining soap content can be found in Fuels and Lubricants Handbook, Technology, Properties, Performance, and Testing, George Totten, editor, ASTM International, 2003, the relevant portions thereof incorporated herein by reference.

In the lubricating oil composition of this disclosure, when mixtures of salicylate detergents are used, of the same or different TBN, the weight ratio of a first salicylate detergent to a second salicylate detergent is from about 1:200 to about 200:1, or from about 1:100 to about 100:1, or from about 1:50 to about 50:1, or from about 1:25 to about 25:1, or from about 1:10 to about 10:1, or from about 1:5 to about 5:1.

In the lubricating oil composition of this disclosure, when mixtures of sulfonate detergents are used, of the same or different TBN, the weight ratio of a first sulfonate detergent to a second sulfonate detergent is from about 1:200 to about 200:1, or from about 1:100 to about 100:1, or from about 1:50 to about 50:1, or from about 1:25 to about 25:1, or from about 1:10 to about 10:1, or from about 1:5 to about 5:1.

In the lubricating oil composition of this disclosure, when mixtures of salicylate detergents and sulfonate detergents are used, of the same or different TBN, the weight ratio of the salicylate detergent to the sulfonate detergent is from about 1:200 to about 200:1, or from about 1:100 to about 100:1, or from about 1:50 to about 50:1, or from about 1:25 to about 25:1, or from about 1:10 to about 10:1, or from about 1:5 to about 5:1.

The detergent concentration in the lubricating oils of this disclosure can range from about 0.001 weight percent to about 20 weight percent, or about 0.01 weight percent to about 10 weight percent, or about 0.5 to about 6.0 weight percent, or about 0.6 to 5.0 weight percent, or from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Other Additives

The formulated lubricating oil useful in the present disclosure may additionally contain one or more of the other commonly used lubricating oil performance additives including but not limited to antiwear additives, dispersants, other detergents, viscosity modifiers, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives in oil can be dispersed in the lubricating oils of this disclosure.

The types and quantities of performance additives used in combination with the instant disclosure in lubricant compositions are not limited by the examples shown herein as illustrations.

Antiwear Additives

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.3 weight percent to about 1.5 weight percent, preferably from about 0.4 weight percent to about 1.2 weight percent, more preferably from about 0.5 weight percent to about 1.0 weight percent, and even more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Other Dispersants

Other suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

The dispersant(s) can be borated by conventional means, as generally disclosed in U.S. Pat. Nos. 3,087,936, 3,254,025 and 5,430,105.

Such dispersants may be used in an amount of about 0.001 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Other Detergents

Illustrative other detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur-containing acid, carboxylic acid (e.g., salicylic acid), phosphorus-containing acid, phenol, or mixtures thereof. The counterion is typically an alkaline earth or alkali metal. The detergent can be overbased.

The detergent can be a metal salt of an organic or inorganic acid, a metal salt of a phenol, or mixtures thereof. The metal can be an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal can be an alkali metal, an alkaline earth metal, and mixtures thereof. Particularly, the metal can be calcium (Ca), magnesium (Mg), and mixtures thereof.

The organic acid or inorganic acid can be a sulfur-containing acid, a carboxylic acid, a phosphorus-containing acid, and mixtures thereof.

In an embodiment, the metal salt of an organic or inorganic acid or the metal salt of a phenol can be calcium phenate, magnesium phenate, an overbased detergent, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium phenates and/or magnesium phenates. The TBN ranges can vary from low, medium to high TBN products, including as low as 0 to as high as 600. The TBN delivered by the detergent is between 1 and 20. The TBN delivered by the detergent can be between 1 and 12. Mixtures of low, medium, high TBN can be used, along with mixtures of calcium and magnesium metal based detergents, and including phenates and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, particularly, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Illustrative detergents include calcium phenates, magnesium phenates, and other related components (including borated detergents), and mixtures thereof. Illustrative mixtures of detergents include calcium phenate and magnesium phenate. Overbased detergents are also used.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the formulated oil or lubricating engine oil. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 weight percent, preferably about 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt. %) indicated below is based on the total weight of the lubricating oil composition.

TABLE 1

Typical Amounts of Other Lubricating Oil Components

| Compound | Approximate Wt. % (Useful) | Approximate Wt. % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Formulations were prepared as described herein. All of the ingredients used herein are commercially available. PCMO (passenger car motor oil) formulations were prepared as described herein.

The lubricating oil base stocks used in the formulations were Group II-V base oils, including ester base stocks, alkylated naphthalene base stocks, liquid amide base stocks, and alkylated diphenyl oxide base stocks.

The dispersants used in the formulations were borated succinimides, non-borated succinimides, and mixtures thereof.

The detergents used in the formulations were alkaline earth metal salicylates, alkaline earth metal sulfonates, and mixtures thereof.

The additive package used in the formulations included conventional additives in conventional amounts. Conventional additives used in the formulations were one or more of an antioxidant, pour point depressant, corrosion inhibitor, metal deactivator, seal compatibility additive, anti-foam agent, inhibitor, anti-rust additive, optional friction modifier, optional antiwear additive, and other optional lubricant performances additives.

Formulation strategies were identified which produce thick tribofilms under sliding/rolling contacts in a ball-on-disk test on a mini-traction machine (MTM). The test conditions, summarized in Table 2 below, serve to approximate possible tribological conditions experienced by chain link plates in contact with the chain link pins in the FCW test. The FCW test is a new test in the ILSAC GF-6 specification.

| | |
|---|---|
| Test type | Ball-on-disk, mini-traction machine |
| Test description | Time step, constant SRR |
| Ball/disk motion | Co-motion |
| Ball material/roughness/radius | AISI 52100/<0.02 μm/19.05 mm |
| Disk material/roughness/diameter | AISI 52100/<0.01 μm/46 mm |
| Bath temperature | 100° C. |
| Ball speed | 50 mm/s |
| Slide to roll (SRR) ratio | 50% |
| Ball Load | 1 GPa |
| Test length | 4 hours |

In the FCW test, elongation of the timing chain due to wear of chain link pins is the rated parameter. It has been observed that the ability to form thick tribofilms can be quantified by the maximum (saturation) traction coefficient $f_s$ measured in the ball-on-disk tribological test by averaging the values of traction coefficient collected in the last 1 hour of the 4-hour time step test (this region of the traction coefficient v. time curve is largely flat.) It has been observed that $f_s$ corresponds to low wear in the FCW engine test. While no limits have been formally set for the FCW test at the current stage of development, for purposes of this disclosure, low wear samples exhibit less than 0.07% chain elongation, which is a conservative estimate of the expected test limits.

The FCW test and the Sequence IVB test are part of the draft ILSAC GF-6 specification, in particular, the draft ILSAC GF-6A Recommendations for Passenger Car Engine Oils dated May 11, 2017, and the draft ILSAC GF-6B Recommendations for Passenger Car Engine Oils dated May 11, 2016, all of which are incorporated herein by reference in their entirety.

FIG. 1 provides a plot of chain elongation as a function of average traction coefficient (tribofilm thickness) under the tribological test conditions specified in Table 2. It can be seen that low chain wear is achieved for samples in which the saturation traction coefficient measured is greater than 0.11. Therefore, formulations with traction coefficients greater than 0.11 are considered as low wear formulations.

The correlation observed between low-wear FCW test formulations and those exhibiting thick tribofilm formation in tribological testing validates the use of the bench test to screen for low-wear, thick tribofilm-forming formulations. From these investigations, several strategies have been identified for achieving thick tribofilms for low wear.

Base Stock

Saturation traction coefficient $f_s$ was measured for various blends in which the only modification to the formulations is the Group V base stock composition. FIG. 2 summarizes the Group V base stocks used, basic physical properties, aniline points (ASTM D611), temperature of 50% volatility (simulated distillation), and saturation traction coefficient of the neat base stock.

The aniline point is the temperature at which equal volumes of aniline and oil are miscible as a single phase, and is thereby a measure of polarity. In the mixed aniline point measurement, n-heptane is added to the mixture to elevate the aniline point. Lower temperatures correspond to a more polar base oil (better compatibility with aniline).

Volatility of the base oil is both a function of polarity, molecular weight, and purity (i.e., if both low and high molecular weight molecules are present in the neat base stock). From this data, it can be seen that alkylated naphthalene base stocks at different viscosities have the lowest temperature for 50% volatility and positive aniline points. Esters largely have aniline points below 0° C., mixed aniline points below 20° C., and higher temperatures for 50% volatility. Liquid amide and alkylated diphenyl oxide Group V base stocks fall in between esters and alkylated naphthalene in terms of aniline point and volatility.

However, these features are not defined by base stock type as related to chemical structure, as exemplified by the 5.5 cSt low polarity monoester. This ester exhibits the highest temperature for 50% volatility of all base stocks tested including the other esters, but also the highest aniline point>60° C. Saturation traction of the neat base stocks in MTM (100° C., 1 GPa, measured at 50 mm/s on the $15^{th}$ pass scanning speeds from 3000-3 m/s) does not correlate to aniline point or volatility. The experimental setup and ball/disk materials used were identical in traction measurements for neat base stocks and fully-formulated oils.

FIG. 3 summarizes saturation traction coefficient $f_s$ for the series of oils in which Group V base stock type was modified. It was found that replacing 5 weight percent C8/C10 trimethylol propane ester (TMP) Group V base stock in Comparative Example A ($f_s$=0.100) with a Group V base stock such as 4.8 or 5.4 cSt alkylated naphthalene (AN) (Inventive Examples 1 and 2, respectively) resulted in thick tribofilm formation, up to $f_s$=0.128 for the 4.8 cSt AN. Substituting the C8/C10 TMP Group V base stock in Comparative Example A with either a liquid amide ($f_s$=0.103) or alkylated diphenyl oxide ($f_s$=0.098), Comparative Examples B and C, respectively, does not permit the formation of a thick tribofilm. The aniline points of these two base stocks are at or slightly above 0° C. The ability to form thick tribofilms corresponds best to base stocks which exhibit an aniline point>10° C. This corresponds to a mixed aniline point>35° C. These properties can thus be used a criteria to select the appropriate Group V base stock for forming thick tribofilms.

Comparative Example D ($f_s$=0.097) demonstrates that the effect of the polar base stock dominates when both a polar (aniline point<0) and nonpolar (aniline point>0) base stock are present. More polar molecules are expected to have stronger interactions with the steel surface than nonpolar molecules, thereby displacing typical surface-active antiwear agents which contribute to tribofilm formation. This may be responsible for the decreased ability of formulations using Group V base stocks with low mixed aniline points (<0) to form thick (high $f_s$) tribofilms. This result is surprising in light of the fact that the saturation traction of the neat base stocks is not correlated with base stock polarity. This is surprising given evidence of frictional improvements in formulations with correspondingly low-friction base stocks in the EHL regime (see WO 2006083632 A1). In the case of the FCW test conditions, the increased friction for low-polarity base stocks is correlated with thick tribofilm-forming behavior.

Inventive Example 1 demonstrates that including 5% 4.8 cSt AN Group V base stock in a formulation results in thick tribofilm-forming ability. An investigation was conducted for preserving a formulation's thick-tribofilm forming ability in the presence of a Group V base stock by increasing the concentration of 4.8 cSt AN in a formulation otherwise identical to Inventive Example 1. These results are summarized in FIG. 4. It was found that saturation traction coefficient $f_s$ of 0.13 was retained from 0-20 weight percent 4.8 cSt AN content (Inventive Examples 1, 3, 4 and 5). Increasing concentration further to 30 weight percent (Comparative Example E) resulted in a steep decrease of saturation traction coefficient $f_s$ to 0.10, thus defining the AN concentration as 0-20 weight percent for the formation of thick tribofilms.

Blends were also prepared in which the amount and structure of the Group V TMP ester was changed. A summary of the formulations and saturation traction coefficients $f_s$ of these blends is shown in FIG. 5 and FIG. 6, respectively. As shown previously in Inventive Example 3, the formulation with 0% Group V base stock exhibited thick tribofilm-forming behavior. However when C8/C10 TMP ester content was increased from 5-50% (Comparative Examples F-H), $f_s$<0.11 across the entire range. Furthermore, the value of $f_s$ remained roughly constant with increasing concentration of TMP ester. In another experiment, various esters were used in identical formulations, all at 50 weight percent (Comparative Examples I-L). All esters used in FIG. 6 had mixed aniline points<20 and thus correspondingly exhibited tribofilms with saturation traction coefficient $f_s$<0.11.

It was found that the impact of Group V base stocks on tribofilm-forming ability was consistent regardless of the makeup of the non-Group V portion of the formulation base stock. FIG. 7 shows the saturation traction coefficient $f_s$ for blends based on the same performance chemistry and using the same Group V base stock (4.8 cSt AN) but different Group II-IV base stock compositions (Inventive Examples 1, 5-8). All show very similar saturation traction coefficients $f_s$ corresponding to thick tribofilm-forming behavior.

High Boron Concentration

Saturation traction coefficient $f_s$ was measured for various blends based on Comparative Example M in which the concentration of borated succinimide dispersant was increased to achieve boron content as listed in FIG. 8. Two borated succinimide dispersants are used here, to emphasize that boron content, not identity of the dispersant, is most critical. FIG. 8 summarizes $f_s$ for boron content of 100-800 ppm boron from a borated succinimide dispersant A. It was found that increasing the concentration of boron from 100 ppm (Comparative Example M) to 200 ppm (Inventive Example 9) permitted a thick tribofilm to form, with corresponding $f_s$ increasing from 0.093 to 0.127, respectively. Further increasing the concentration of boron up to 800 ppm (Inventive Example 12) retained thick tribofilm-forming ability, with no discernible increase in $f_s$ compared to the 200 ppm level. Inventive Examples 9-12 represent thick-tribofilm forming lubricant formulations which are expected to provide suitable wear protection in the FCW test.

Comparative Examples N, O, and P described in FIG. 8 are formulations in which a non-borated succinimide dispersant was added at the same concentration as borated succinimide dispersant used in Comparative Example M, Inventive Example 11 and Inventive Example 12, respectively. There is no boron content in Comparative Examples K-M. Saturation traction coefficients, $f_s$, for these non-boron containing formulations are all less than 0.11 despite having equivalent dispersant nitrogen content as the corresponding Inventive examples. This means that none of these formulations provide adequately thick tribofilm formation to provide wear protection in the FCW test. This emphasizes that boron content, not active dispersant nitrogen, is responsible for the enhancement in tribofilm-forming ability observed in Inventive Examples 9-12 (boron content>200 ppm). The range of 200-350 ppm represents the desired range for the formation of thick tribofilms by high boron content, in the presence of C8/C10 TMP Ester Group V base stock.

FIG. 9 compares saturation traction coefficient $f_s$ of blends prepared with equivalent boron concentrations but different borated succinimide dispersants, and thus different borated dispersant treat rates and dispersant nitrogen content. The tribofilm-forming behavior of Comparative Examples M and Q which contain 5% C8/C10 TMP Ester and 100 ppm B are equivalent, with $f_s$~0.09.

FIG. 10 shows the impact that boron concentration has on formulations which use Group V base stocks 4.3 cSt AN and a monoester formed by reacting a C19 acid with a C20 alcohol, instead of C8/C10 TMP ester. Inventive Examples 13 and 14 demonstrate that the thick tribofilm-forming properties of 4.3 cSt AN-containing sample Inventive Example 1 is maintained at all boron concentrations from 200-350 ppm B. Moreover, saturation traction coefficient $f_s$ is constant as a function of boron concentration, suggesting that AN Group V concentration is the dominating factor for thick tribofilm-forming ability in boron-containing formulations and AN Group V-containing formulations. For samples using the monoester Group V, all boron concentrations at or above 200 ppm boron permits the formation of thick tribofilms (Inventive Examples 15-18.)

Low Detergent Soap Level

Saturation traction coefficient $f_s$ was measured for various lubricant blends based on Comparative Example Q in which the detergent mix was modified to change overall detergent soap concentration in the formulation while maintaining a constant concentration of detergent metals (Mg and Ca). All Mg is added to the formulation through a high TBN magnesium sulfonate detergent, so the concentration of this component remained unchanged in this study and only Ca salicylate detergent levels were adjusted. FIG. 11 summarizes $f_s$ for these formulations. Above 0.1 weight percent detergent soap content (Comparative Examples Q and S), $f_s$ is roughly equivalent at 0.095. These formulations are not thus not able to provide adequate wear protection because they do not form thick tribofilms with $f_s$>0.11. Decreasing detergent soap content to 0.8 weight percent (Inventive Example 19) provides a suitable formulation for wear protection at $f_s$=0.11. Further decreasing detergent soap content to 0.5 weight percent (Inventive Example 20) leads to large enhancement in thick tribofilm-forming ability ($f_s$=0.13.) 0.5-0.8 weight percent detergent soap. As in the case of low polarity Group V base stocks which consequently exhibit low volatility in simulated distillation measurements, detergent soap molecules are likely to interact with steel surfaces in the engine, competing with antiwear agents that contribute to thick tribofilm formation and protect against wear. Though in principle detergent soap can be reduced further than what is demonstrated here, it is anticipated that soap content significantly lower than 0.5 wt % will negatively impact cleanliness protection and is therefore impractical.

As shown by the Examples, this disclosure provides a range of methods to improve wear performance by increasing tribofilm thickness. A main advantage of this disclosure is the ability to increase tribofilm thickness without impacting ash levels or catalyst compatibility (phosphorus content/volatility) of the lubricant. These are two common issues with the standard method for improving wear by increasing the amount of standard antiwear ZDDPs or molybdenum-containing compounds to increase tribofilm thickness. Also, in accordance with this disclosure, various options are provided for improving wear performance depending on desired performance level in other performance parameters such as oxidative stability (where replacing ester with AN is less favorable) or ash/TBN ratio (where detergent formulation may be fixed).

PCT and EP Clauses:

1. A method for improving wear control of a steel surface lubricated with a lubricating oil, said method comprising: (i) using as the lubricating oil a formulated oil, said formulated oil having a composition comprising at least one lubricating oil base stock as a major component; and at least one lubricating oil additive, as a minor component; and (ii) forming a tribofilm on the steel surface; wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

2. A method for improving wear control of a steel surface lubricated with a lubricating oil, said method comprising: (i) using as the lubricating oil a formulated oil, said formulated oil having a composition comprising at least one lubricating oil base stock as a major component; and at least one lubricating oil additive, as a minor component; and (ii) forming a tribofilm on the steel surface; wherein the at least one lubricating oil base stock comprises a Group V base stock having an aniline point greater than 10° C., or a mixed aniline point greater than 35° C., as determined by ASTM D611; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

3. A method for improving wear control of a steel surface lubricated with a lubricating oil, said method comprising: (i) using as the lubricating oil a formulated oil, said formulated oil having a composition comprising at least one lubricating oil base stock as a major component; and at least one dispersant, as a minor component; and (ii) forming a tribofilm on the steel surface; wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

4. A method for improving wear control of a steel surface lubricated with a lubricating oil, said method comprising: (i) using as the lubricating oil a formulated oil, said formulated oil having a composition comprising at least one lubricating oil base stock as a major component; and at least one dispersant, as a minor component; and (ii) forming a tribofilm on the steel surface; wherein the at least one lubricating oil base stock comprises an ester base stock; wherein the at least one dispersant comprises at least one borated dispersant; wherein the at least one borated dispersant is present in an amount sufficient to provide a total boron concentration of 200 to 800 parts per million in the lubricating oil; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

5. A method for improving wear control of a steel surface lubricated with a lubricating oil, said method comprising: (i) using as the lubricating oil a formulated oil, said formulated oil having a composition comprising at least one lubricating oil base stock as a major component; and at least one detergent, as a minor component; and (ii) forming a tribofilm on the steel surface; wherein the total amount of soap delivered by the at least one detergent is 0.5 weight percent to 0.8 weight percent of the lubricating oil; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

6. The method of clauses 1-5 wherein elongation of timing chain due to wear of chain link pins is less than 0.07%, as determined by Ford Chain Wear (FCW) test in accordance with ILSAC GF-6 specification.

7. The method of clauses 1-5 wherein the lubrication regime at the steel surface comprises boundary- and mixed-layer lubrication contacts.

8. The method of clauses 1-5 wherein the steel surface comprises the surface of a timing chain.

9. The method of clauses 1-5 for improving soot-induced wear control of a steel surface.

10. The method of clauses 1 and 2 wherein the at least one lubricating oil additive comprises a dispersant, a detergent, or mixtures thereof.

11. A lubricating oil composition comprising at least one lubricating oil base stock as a major component; and at least one lubricating oil additive, as a minor component; wherein the at least one lubricating oil base stock and the at least one lubricating oil additive are present in an amount to form a tribofilm on a steel surface; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

12. A lubricating oil composition comprising at least one lubricating oil base stock as a major component; and at least one lubricating oil additive, as a minor component; wherein the at least one lubricating oil base stock comprises a Group V base stock having an aniline point greater than 10° C., or a mixed aniline point greater than 35° C., as determined by ASTM D611; wherein the at least one lubricating oil base stock and the at least one lubricating oil additive are present in an amount to form a tribofilm on a steel surface; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

13. A lubricating oil composition comprising at least one lubricating oil base stock as a major component; and at least one dispersant, as a minor component; wherein the at least one lubricating oil base stock and the at least one dispersant are present in an amount to form a tribofilm on a steel surface; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

14. A lubricating oil composition comprising at least one lubricating oil base stock as a major component; and at least one dispersant, as a minor component; wherein the at least one lubricating oil base stock comprises an ester base stock; wherein the at least one dispersant comprises at least one borated dispersant; wherein the at least one borated dispersant is present in an amount sufficient to provide a total boron concentration of 200 to 800 parts per million in the lubricating oil; wherein the at least one lubricating oil base stock and the at least one dispersant are present in an amount to form a tribofilm on a steel surface; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

15. A lubricating oil composition comprising at least one lubricating oil base stock as a major component; and at least one detergent, as a minor component; wherein the total amount of soap delivered by the at least one detergent is 0.5 weight percent to 0.8 weight percent of the lubricating oil; wherein the at least one lubricating oil base stock and the at least one detergent are present in an amount to form a tribofilm on a steel surface; and wherein, in time-step tribofilm formation measurements of the lubricating oil by a mini-traction machine (MTM) at constant slide-to-roll ratio (SRR), the saturation traction coefficient ($f_s$), which correlates to tribofilm thickness on the steel surface, is greater than 0.11.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for improving wear control of a steel surface lubricated with a lubricating oil, said method comprising: (i) using as the lubricating oil a formulated oil, said formulated oil having a composition comprising at least one lubricating oil base stock as a major component; and at least one lubricating oil additive, as a minor component; and (ii) forming a tribofilm on the steel surface having a saturation traction coefficient ($f_s$), which correlates to the tribofilm thickness on the steel surface, of greater than about 0.11, as measured in a ball-on-disk tribological test by a mini-traction machine (MTM) at constant slide-to-roll ratio (SRR), wherein the at least one lubricating oil base stock has an aniline point greater than about 10° C., or a mixed aniline point greater than about 35° C., as determined by ASTM D611.

2. The method of claim 1 wherein elongation of timing chain due to wear of chain link pins is less than about 0.07%, as determined by Ford Chain Wear (FCW) test in accordance with ILSAC GF-6 specification.

3. The method of claim 1 wherein the lubrication regime at the steel surface comprises boundary- and mixed-layer lubrication contacts.

4. The method of claim 1 wherein the steel surface comprises the surface of a timing chain.

5. The method of claim 1 for improving soot-induced wear control of a steel surface.

6. The method of claim 1 wherein the at least one lubricating oil additive comprises a dispersant, a detergent, or mixtures thereof.

7. The method of claim 6 wherein the dispersant comprises a borated or non-borated, hydrocarbyl-substituted succinic acid, a borated or non-borated, hydrocarbyl-substituted succinic anhydride derivative, or mixtures thereof.

8. The method of claim 6 wherein the dispersant comprises a borated succinimide, a non-borated succinimide, or mixtures thereof.

9. A method for improving wear control of a steel surface lubricated with a lubricating oil, said method comprising:

(i) using as the lubricating oil a formulated oil, said formulated oil having a composition comprising at least one lubricating oil base stock as a major component; and at least one borated dispersant, as a minor component; and (ii) forming a tribofilm on the steel surface having a saturation traction coefficient ($f_s$), which correlates to the tribofilm thickness on the steel surface, of greater than about 0.11, as measured in a ball-on-disk tribological test by a mini-traction machine (MTM) at constant slide-to-roll ratio (SRR), wherein the at least one lubricating oil base stock has an aniline point greater than about 10° C., or a mixed aniline point greater than about 35° C., as determined by ASTM D611, and wherein the borated dispersant is present in an amount sufficient to provide a total boron concentration of about 200 to about 800 parts per million in the lubricating oil.

10. The method of claim 6 wherein the detergent comprises an alkaline earth metal salicylate, an alkaline earth metal sulfonate, or mixtures thereof.

11. The method of claim 6 wherein the detergent comprises an alkaline earth metal salicylate, a mixture of alkaline earth metal salicylates, an alkaline earth metal sulfonate, a mixture of alkaline earth metal sulfonates, or a mixture of alkaline earth metal salicylates and alkaline earth metal sulfonates, all having the same or different total base number (TBN).

12. The method of claim 6 wherein, for a mixture of alkaline earth metal salicylates and alkaline earth metal sulfonates, all having the same or different total base number (TBN), the weight ratio of alkaline earth metal salicylates to alkaline earth metal sulfonates is from about 1:100 to about 100:1.

13. The method of claim 6 wherein, for a mixture of alkaline earth metal salicylates having the same or different total base number (TBN), the weight ratio of a first alkaline earth metal salicylate to a second alkaline earth metal salicylate is from about 1:100 to about 100:1; or wherein, for a mixture of alkaline earth metal sulfonates having the same or different total base number (TBN), the weight ratio of a first alkaline earth metal sulfonate to a second alkaline earth metal sulfonate is from about 1:100 to about 100:1.

14. The method of claim 6 wherein the total amount of soap delivered by the detergent is about 0.5 weight percent to about 0.8 weight percent of the lubricating oil.

15. The method of claim 1 wherein the at least one lubricating oil base stock comprises an ester base stock, an alkylated naphthalene base stock, or mixtures thereof.

16. The method of claim 1 wherein the lubricating oil base stock further comprises a Group I, Group II, Group III, Group IV or Group V base oil.

17. The method of claim 1 wherein the at least one lubricating oil additive is present in an amount of from about 0.001 weight percent to about 20 weight percent, based on the total weight of the formulated oil.

18. The method of claim 1 wherein the lubricating oil base stock is present in an amount of from about 6 weight percent to about 95 weight percent, based on the total weight of the formulated oil.

19. The method of claim 1 wherein the formulated oil further comprises one or more of an antiwear additive, other viscosity modifiers, antioxidant, other detergent, other dispersant, pour point depressant, corrosion inhibitor, metal deactivator, seal compatibility additive, anti-foam agent, inhibitor, and anti-rust additive.

20. The method of claim 1 wherein the lubricating oil is a passenger vehicle engine oil (PVEO).

21. A lubricating oil composition comprising at least one lubricating oil base stock as a major component; and at least one lubricating oil additive, as a minor component; wherein the at least one lubricating oil base stock and the at least one lubricating oil additive are present in an amount to form a tribofilm on a steel surface having a saturation traction coefficient ($f_s$), which correlates to the tribofilm thickness on the steel surface, of greater than about 0.11, as measured in a ball-on-disk tribological test by a mini-traction machine (MTM) at constant slide-to-roll ratio (SRR).

22. The method of claim 9 wherein elongation of timing chain due to wear of chain link pins is less than about 0.07%, as determined by Ford Chain Wear (FCW) test conducted in accordance with ILSAC GF-6 specification.

23. The method of claim 9 wherein the lubrication regime at the steel surface comprises boundary- and mixed-layer lubrication contacts.

24. The method of claim 9 wherein the steel surface comprises the surface of a timing chain.

25. The method of claim 9 wherein at least one borated dispersant comprises a borated hydrocarbyl-substituted succinic acid, a borated hydrocarbyl-substituted succinic anhydride derivative, or mixtures thereof.

26. The method of claim 9 wherein the at least one borated dispersant comprises a borated succinimide, or mixtures thereof.

27. The method of claim 9 wherein the borated dispersant is present in an amount sufficient to provide a total boron concentration of about 250 to about 750 parts per million in the lubricating oil.

28. The method of claim 9 wherein the lubricating oil base stock further comprises a Group I, Group II, Group III, Group IV or Group V base oil.

29. The method of claim 9 wherein the at least one borated dispersant is present in an amount of from about 0.001 weight percent to about 20 weight percent, based on the total weight of the formulated oil.

30. The method of claim 9 wherein the lubricating oil base stock is present in an amount of from about 6 weight percent to about 95 weight percent, based on the total weight of the formulated oil.

31. The method of claim 9 wherein the formulated oil further comprises one or more of an antiwear additive, other viscosity modifiers, antioxidant, detergent, other dispersant, pour point depressant, corrosion inhibitor, metal deactivator, seal compatibility additive, anti-foam agent, inhibitor, and anti-rust additive.

32. The method of claim 9 wherein the lubricating oil is a passenger vehicle engine oil (PVEO).

* * * * *